United States Patent [19]

Schmidt et al.

[11] Patent Number: 5,069,180

[45] Date of Patent: Dec. 3, 1991

[54] AUTOMATIC CHOKE APPARATUS AND METHOD

[75] Inventors: Thomas A. Schmidt, Eden Prairie; David A. Overland, Cedar; Paul F. Huffman, Blaine; Paige R. Nelson, Minnetonka, all of Minn.

[73] Assignee: Onan Corporation, Minneapolis, Minn.

[21] Appl. No.: 600,446

[22] Filed: Oct. 19, 1990

[51] Int. Cl.[5] ..... F02D 31/00; F02M 1/02

[52] U.S. Cl. ..... 123/376; 123/179.18; 261/39.4

[58] Field of Search ..... 123/179 G, 376, 396, 123/400, 403; 261/39.2, 39.3, 39.4

[56] References Cited

U.S. PATENT DOCUMENTS

| | | | |
|---|---|---|---|
| 2,638,082 | 5/1953 | Dillard | 123/389 |
| 2,837,070 | 6/1958 | Agar | 123/376 X |
| 3,606,983 | 9/1971 | Mitchell | 261/39.3 |
| 3,794,004 | 2/1974 | Stoltman | 123/324 |
| 3,869,528 | 3/1975 | Mick | 261/39.2 |
| 3,886,917 | 6/1975 | Nakada et al. | 261/39.4 |
| 3,965,224 | 6/1976 | Freismuth | 261/39.3 |
| 4,078,024 | 3/1978 | Bockelmann et al. | 261/39.3 |
| 4,517,942 | 5/1985 | Pirkey et al. | 123/376 |
| 4,961,409 | 10/1990 | Kobayashi et al. | 123/376 |

*Primary Examiner*—Willis R. Wolfe

*Attorney, Agent, or Firm*—Merchant, Gould, Smith, Edell, Welter & Schmidt

[57] ABSTRACT

An automatic choke apparatus is provided having a choke plate mounted for variable rotation in a carburetor between a closed position and an open position wherein a flow of air entering the carburetor is substantially obstructed in the closed position compared to the open position whereby the flow of fuel entering the engine is increased when in the closed position. The choke plate has a choke shaft arm for rotatably moving the choke plate. The automatic choke apparatus has a throttle plate downstream from the choke plate mounted for variable rotation in the carburetor between an open position wherein a flow of air and fuel mixture exiting the carburetor is at a maximum and a closed position wherein the flow of air and fuel mixture exiting the carburetor is at a minimum. The throttle plate has a throttle lever for rotatably miving the throttle plate. The throttle lever is engagable with the choke shaft arm as the throttle plate is rotated toward the closed position to rotatably move the choke plate toward the open position. The automatic choke apparatus includes engine speed governing structure for moving the throttle plate to limit the maximum speed of the engine. The engine speed governing structure urges the throttle plate toward the closed position after the engine is started such that the throttle lever engages the choke shaft arm to move the choke plate toward the open position.

21 Claims, 5 Drawing Sheets

AUTOMATIC CHOKE APPARATUS AND METHOD

FIELD OF THE INVENTION

The present invention relates generally to an automatic choke for an internal combustion engine. More particularly, the present invention relates to an automatic choke actuated by an engine speed governor apparatus.

BACKGROUND OF THE INVENTION

When starting an internal combustion engine in cold ambient temperatures, it is often necessary to regulate the amount of air entering the carburetor. In general, the engine requires a richer fuel to air mixture to start the engine when the engine is cold. Once the engine heats up, a leaner mixture is required. One method of regulating the amount of air entering the carburetor is to control movement of a choke plate rotatably mounted in an interior of the carburetor. The choke plate is typically movable between a closed position wherein the choke plate sbstantially obstructs a flow of air entering the carburetor, and an open position wherein the airflow is substantially unobstructed. When the choke plate is in the closed position, more fuel is drawn into the engine during starting to provide the engine with a richer fuel to air mixture. To start the engine in cold ambient temperatures in a system having a rotatable choke plate, the choke plate is initially placed in a closed position to increase the amount of fuel entering the engine. After the engine is started, the engine requires an increased amount of air and a decreased amount of fuel to avoid stalling, so the choke plate is moved toward a more open position.

In the past, various apparatus have been employed for starts in cold ambient temperatures to automatically move the choke plate to a more closed position during the initial starting and then to a more open position after the engine is started. Conventional automatic choke apparatus and choke pull off devices include apparatus having structure which is electrically operated and apparatus having structure which is vacuum operated. These apparatus also typically include a temperature sensing device which responds to engine temperature sensed and positions the choke plate in a closed position for starting when the engine is cold and then positions the choke plate in an open position once the engine is started and has heated up. However, in those apparatus, the temperature sensing devices are slow to react, requiring some additional structure to move the choke plate to the partially open position immediately after start up before the temperature sensing device has reacted to prevent the engine from stalling. In those conventional apparatus, it is the electrically or vacuum operated structures that move the choke plate to the partially open position immediately after the engine is started to prevent stalling.

As the name suggests, the conventional electrically operated apparatus require the presence of an electrical connection to a source of electrical power to move the choke plate. Similarly, the conventional vacuum operated apparatus require the presence of air pressure differentials to move the choke plate. Oftentimes both the electrically operated apparatus and the vacuum operated apparatus employ intricate and fragile structure requiring a great number of parts to move the choke plate. As a result, both types of apparatus are often costly to manufacture and are prone to failure especially in the harsh environments surrounding most internal combustion engine applications.

It is clear that there has existed a long and unfilled need in the prior art for an automatic choke apparatus and method for automatically controlling movement of the choke plate during cold ambient starts while addressing the above recited problems, or similar problems.

SUMMARY OF THE INVENTION

The present invention relates to a choke pull off device for use on a carburetor wherein the carburetor is provided with a choke plate rotatably mounted to the carburetor about a choke shaft defining an axis of rotation for the choke plate. The carburetor is further provided with a throttle plate rotatably mounted to the carburetor about a throttle shaft defining an axis of rotation of the throttle plate. The choke pull off device includes a choke shaft arm mountable to the choke shaft for rotatably moving the choke plate about the axis of rotation of the choke plate. The choke pull off device further includes a throttle lever mountable to the throttle shaft for rotatably moving the throttle plate about the axis of rotation of the throttle plate. The throttle lever includes mechanical linkage structure for engaging the choke shaft arm during rotational movement of the throttle plate to rotatably move the choke plate. In this manner, the choke pull off device provides movement of the choke plate through mechanical interaction of the throttle lever and the choke shaft arm.

The present invention also relates to an automatic choke apparatus for use in starting an internal combustion engine. The automatic choke apparatus includes a carburetor having an air inlet, a fuel inlet, and an air and fuel mixture outlet. The apparatus further includes a choke plate mounted for variable rotation in an interior of the carburetor adjacent the air inlet such that the choke plate is rotatable between a closed position wherein a flow of air entering the carburetor is substantially obstructed and an open position wherein the flow of air entering the carburetor is substantially unobstructed. The choke plate has a choke shaft arm for rotatably moving the choke plate. The automatic choke apparatus further includes a throttle plate downstream from the choke plate and the fuel inlet mounted for variable rotation in the interior of the carburetor such that the throttle plate is rotatable between an open position wherein a flow of air and fuel mixture exiting the carburetor is at a maximum and a closed position wherein the flow of air and fuel mixture exiting the carburetor is at a minimum. The throttle plate has a throttle lever for rotatably moving the throttle plate. The choke plate is rotatable toward the open position and the throttle plate is rotatable toward the closed position after the engine is started. The throttle lever is engagable with the choke shaft arm as the throttle plate is rotated toward the closed position to rotatably move the choke plate toward the open position.

The present invention further relates to an internal combustion engine having an automatic choke. The engine includes a carburetor having a choke plate mounted for variable rotation about a choke shaft in an interior of an inlet to the carburetor. The choke shaft has a choke shaft arm for rotatably moving the choke shaft and the choke plate. The carburetor is further provided with structure for supplying air and for supplying fuel to the interior of the carburetor for mixing. The carburetor further has a throttle plate mounted for variable rotation about a throttle shaft in the interior of the carburetor downstream of the choke plate and the structure for supplying fuel. The throttle shaft has a throttle lever for rotatably moving the throttle shaft and the throttle plate. The throttle lever is engagable with the choke shaft arm as the throttle lever rotatably moves the throttle plate to rotatably move the choke plate. The carburetor further has structure for supplying a mixture of the fuel and the air to combustion structure of the engine.

In addition to the carburetor, the internal combustion engine further includes temperature responsive structure for moving the choke plate toward an open position as the engine temperature increases. The temperature responsive structure moves the choke plate toward a closed position as engine temperature sensed decreases. The combustion structure is provided for converting the air and fuel mixture supplied by the carburetor to rotational movement of an engine output shaft. Governor structure is provided for moving the throttle lever and throttle plate to limit the maximum rotational speed of the engine output shaft by urging the throttle plate from an open position toward a closed position after the engine is started. During rotational movement, the throttle lever engages the choke shaft arm and rotatably moves the choke shaft arm which rotatably moves choke plate toward the open position before the temperature responsive structure activates to open the choke plate. In this manner, the engine will not be as likely to stall during cold ambient starts caused by the choke plate not being sufficiently moved toward the open position by the temperature responsive structure.

This invention also relates to a method for preventing stalling during starting of an internal combustion engine in cold ambients. The method includes the step of providing a carburetor mountable to the engine having a choke plate and a throttle plate rotatably mounted in an interior of the carburetor. A choke shaft arm is connected to the choke plate for rotatably moving the choke plate. A throttle lever is connected to the throttle plate for rotatably moving the throttle plate. The throttle lever is mechanically linked with the choke shaft arm during rotational movement of the throttle plate to cause rotational movement of the choke plate. The method further includes the steps of: positioning the choke plate in a closed position wherein a flow of fuel entering the engine during starting is greater relative to when the choke plate is in an open position; positioning the throttle plate in an open position wherein a flow of air and fuel mixture exiting the carburetor is greater than when in a closed position; starting the engine; and rotating the throttle plate toward the closed position after the engine is started wherein the flow of air and fuel mixture exiting the carburetor is decreased, and the rotation of the throttle plate causes the throttle lever to move the choke shaft arm causing rotation of the choke plate toward the open position wherein the flow of fuel entering the engine is decreased.

BRIEF DESCRIPTION OF THE DRAWINGS

In the drawings, wherein like reference numerals generally indicate corresponding parts throughout the several views.

DETAILED DESCRIPTION OF THE PREFERRED EMBODIMENT

Figure 1:
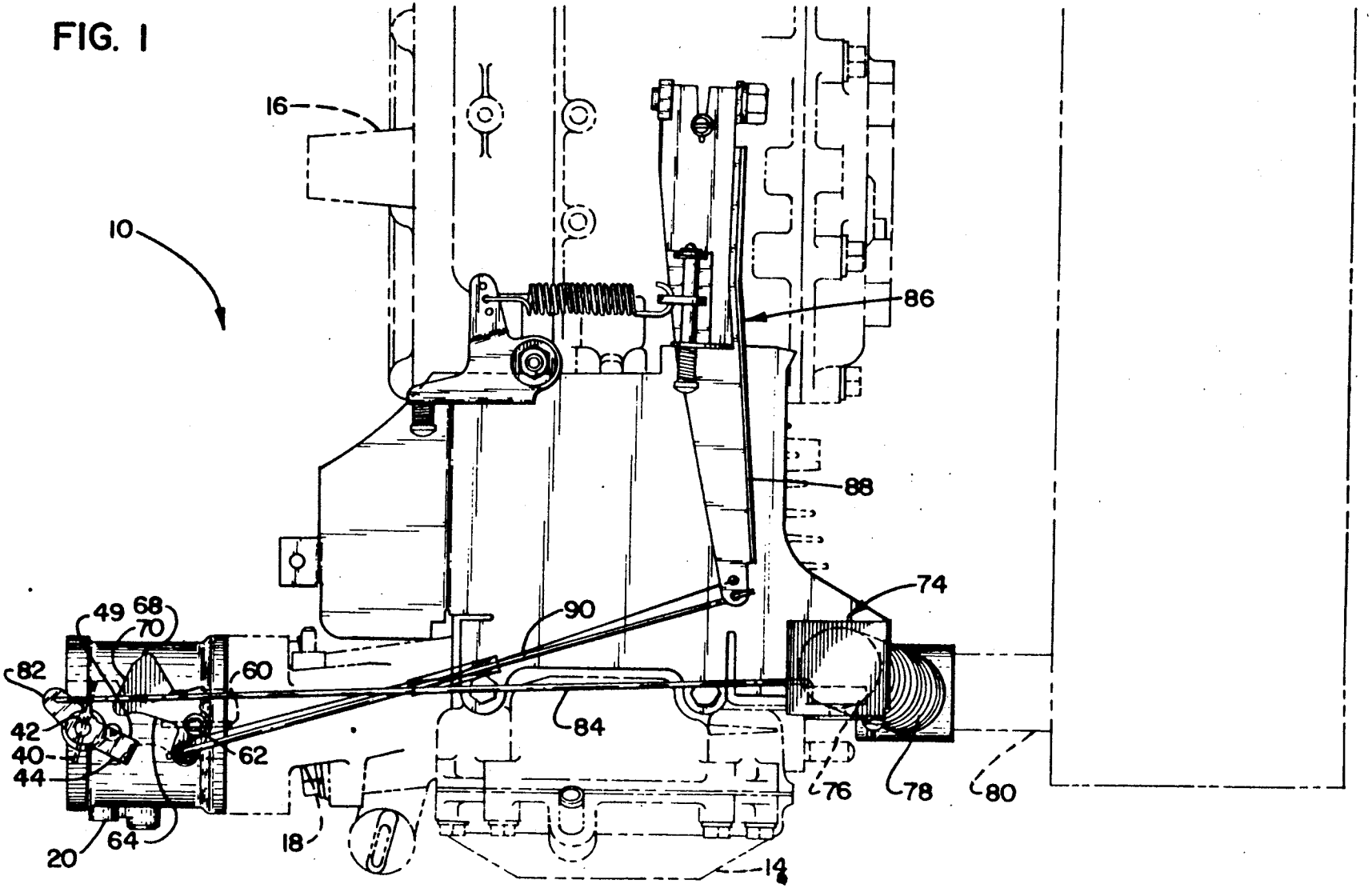
FIG. 1 is a top view of a preferred embodiment of an automatic choke apparatus according the present invention showing the apparatus mounted to an internal combustion engine.
Figure 2:
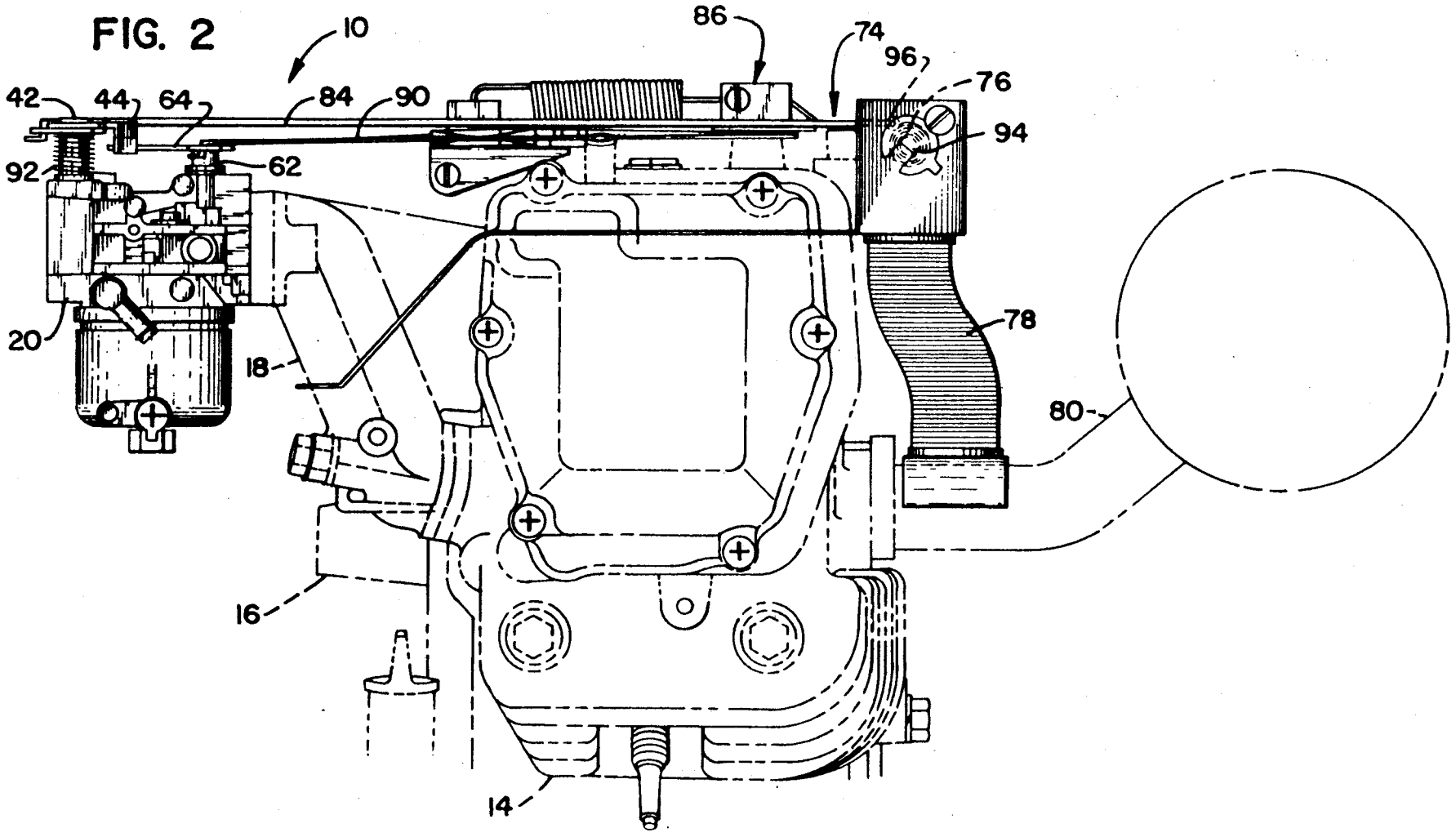
FIG. 2 is a front view of the automatic choke apparatus shown in FIG. 1.

Referring now to FIGS. 1-7, a preferred embodiment of an automatic choke apparatus or automatic choke 10 is shown according to principles of the present invention. As shown in FIGS. 1 and 2, the automatic choke 10 is mounted to an internal combustion engine 14. In the preferred embodiment, the internal combustion engine 14 is part of a generator set where the engine has an output shaft 16 which mechanically drives a generator (not shown) for generating electrical current. It is anticipated that the automatic choke 10 of the present invention could be used with other engines for other applications besides in connection with generator sets.

The automatic choke 10 of the present invention includes a carburetor 20 for supplying a mixture of air and fuel to an intake manifold 18 of the engine 14. As best shown in the partial enlarged views of FIGS. 3-7, a flow of air, represented by arrow 30, enters the carburetor 20 at an air inlet 22, and a flow of fuel, represented by arrow 32, enters the carburetor through a fuel inlet 24. The air and fuel travel through the carburetor 20 in an interior passageway 28 during which the air and fuel become mixed. The air and fuel mixture, represented by arrow 34, exits the carburetor at an outlet 26 and enters the intake manifold 18 of the engine 14. Combustion structure within the engine converts the air and fuel mixture to rotational movement of the engine output shaft 16 during the combustion process.

To control the amount of fuel entering the engine 14 during starting, a choke plate 40 is rotatably mounted in the passageway 28 of the carburetor 20 adjacent the air inlet 22. The choke plate 40 is rotatable between an open position, shown in FIGS. 5 and 6, wherein the flow of air entering the carburetor 20 is sustantially obstructed, and a closed position, shown in FIG. 3, wherein the flow of air entering the carburetor is substantially unobstructed. In the closed position, the flow of fuel into the carburetor 20 and the engine 14 is greater than when in the open position during starting. It should be noted that the choke plate 40 is variably positionable in positions between the open position and the closed position. The choke plate 40 is rotatably mounted to the carburetor 20 by a choke shaft 42 which defines an axis of rotation 46 (see FIG. 7) of the choke plate 40. The choke shaft 42 extends through the carburetor wall to an exterior of the carburetor. A choke shaft arm 44 on the exterior of the carburetor is provided to rotatably move the choke plate 40. A rigid connection between the choke shaft arm 44, the choke shaft 42, and the choke plate 40 permits the choke plate to be rotatably moved between the open position and the closed position by movement of the choke shaft arm.

A throttle plate 60 is rotatably mounted in the passageway 28 of the carburetor 20 downstream from the choke plate 40 and the fuel inlet 24 to control the amount of air and fuel mixture which exits the carburetor 20 at the outlet 26. A throttle shaft 62 mounts the throttle plate 60 to the carburetor 20 and defines an axis of rotation 66 (see FIG. 7) of the throttle plate. The throttle plate 60 is rotatable between an open position, shown in FIG. 3, wherein the air and fuel mixture exiting the carburetor 20 at outlet 26 is at a maximum, and a closed position, shown in FIG. 5, wherein the air and fuel mixture exiting the carburetor is at a minimum. It should be noted that the throttle plate 60 is variably positionable between the open position and the closed position. The throttle shaft 62 extends through the carburetor wall to the exterior of the carburetor where a throttle lever 64 attaches to the throttle shaft. A rigid connection exists between the throttle lever 64, the throttle shaft 62, and the throttle plate 60 which permits the throttle plate to be rotatably moved between the open position and the closed position by movement of the throttle lever.

As will be discussed below, the throttle lever 64 and the choke shaft arm 44 are mechanically linked to each other to interact during operation of the engine such that rotational movement of the throttle plate 60 causes some rotational movement of the choke plate 40. The preferred structure which interacts during operation of the engine includes a cam surface on one of the members and an elongate portion on the other member which slideably engages the cam surface and follows the cam surface during operation. In the preferred embodiment, the throttle lever 64 is provided with a cam surface 70 and the choke shaft arm 44 is provided with an elongate portion 49 which follows the cam surface 70. The throttle lever 64 preferably includes a cam plate portion 68 extending from the throttle shaft 62 in a general perpendicular direction to the throttle shaft. The cam surface 70 forms an edge of the cam plate portion 68. The choke shaft arm 44 preferably has a first elongate member 50 extending generally perpendicular to the choke shaft 42 and a second elongate member 52 extending from the first elongated member in a direction generally parallel to the choke shaft. During rotational movement of the throttle lever 64 to move the throttle plate 60 from the open position toward the closed position, the cam surface 70 of the throttle lever 64 slidably engages the second elongate member 52 of the choke shaft arm 44 to rotatably move the choke plate 40 from the closed position toward the open position. It should be noted that the throttle lever 64 and choke shaft arm 44 can be mechanically linked in a variety of different manners other than the manner shown in the preferred embodiment such that movement of the throttle plate is translated to movement of the choke plate. Further, even though in the preferred embodiment the throttle lever 64 and choke shaft arm 44 interaction takes place on an exterior of the carburetor 20, the automatic choke 10 could be configured such that the interaction takes place in the interior of the carburetor.

The cam surface 70 and cam plate portion 68 are shaped to allow for optimum choke plate position for various loads and throttle plate settings for the engine 14. It is to be appreciated that the cam plate portion 68 and cam surface 70 could have various configurations depending upon the characteristics and requirements of the engine 14. One method of changing the configuration of the cam plate portion 68 without removing the cam plate portion is to construct the cam plate portion from a bimetal material. The resulting cam plate portion would have a configuration which would be changeable with temperature.

In the preferred embodiment, a temperature responsive device 74 is provided for positioning the choke plate 40 based on engine temperature sensed by the temperature responsive device. To facilitate starting the engine 14 in cold ambients, the temperature responsive device 74 automatically positions the choke plate 40 toward a more closed position to obstruct the flow of air to increase the flow of fuel entering the engine 14. After the engine 14 is started and the engine heats up, the temperature responsive device 74 automatically positions the choke plate 40 in the open position since an increased flow of fuel is no longer required.

During operation of the engine 14, choke plate position is sometimes determined by the temperature responsive device 74 and other times by the choke shaft arm 44/throttle lever 64 interaction. The temperature responsive device 74 positions the choke plate 40 at start up of the engine, and then after the engine heats up. The choke shaft arm 44/throttle lever 64 interaction positions the choke plate 40 from a time immediately after start up until the engine heats up. As noted above, this cooperation is necessary because the temperature responsive device 74 does not respond fast enough to move the choke plate 40 to a more open position to prevent stalling of the engine. In order to move the choke plate 40 toward a more open position during the time in which the temperature responsive device 74 has yet to react sufficiently, the choke shaft arm 44 is rotatably moved by the cam surface 70 of the throttle lever 64 immediately after start up when a more open choke is necessary.

Figure 5:
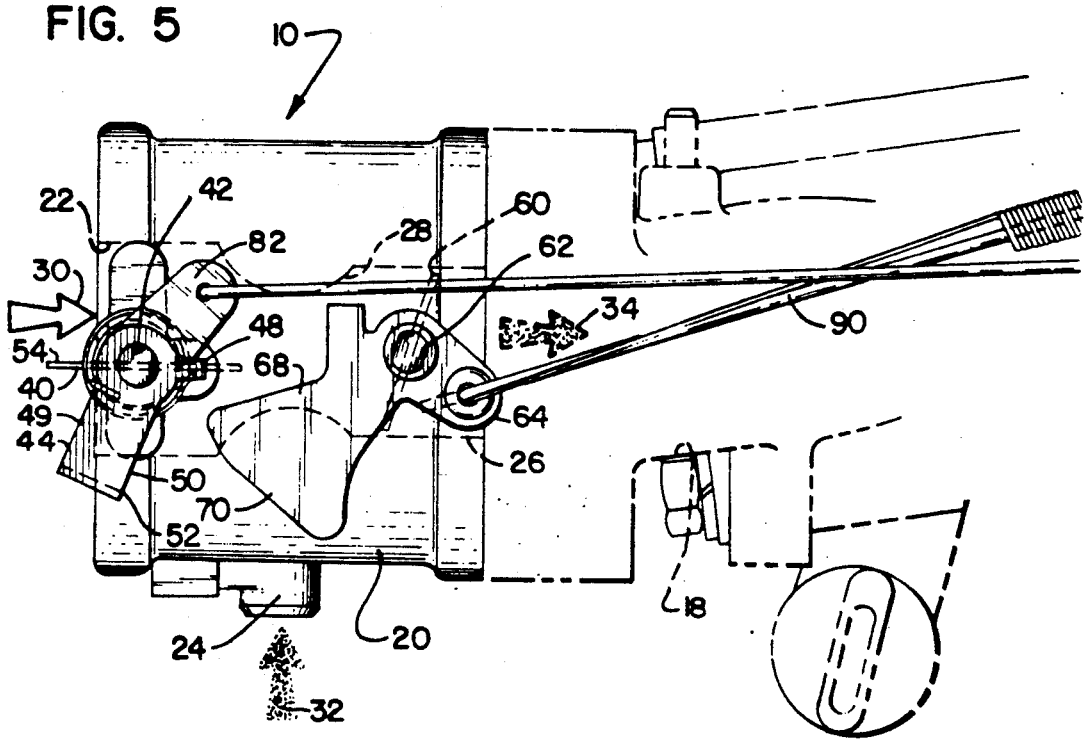
FIG. 5 is a partial enlarged top view of the automatic choke apparatus shown in FIG. 1 showing the positions of several elements of the apparatus when the engine is running at light load and warmed.

Referring now to FIGS. 1 and 2, the temperature responsive device 74 includes a bimetal strip 76 for sensing temperature of the engine 14. The bimetal strip 76 is rigidly connected at a first end 94 to the engine 14 and at a second end 96 to a choke rod 84. The choke rod 84 is linked to a choke rod arm 82 which is mounted for rotation about the choke shaft 42. In the preferred embodiment, the bimetal strip 76 is in the shape of a coil and is exposed to air heated by engine exhaust. A tube 78 provides a passageway for air heated by an exhaust manifold 80 to travel to the bimetal strip 76. In operation in cold ambients, the bimetal strip exerts a pull on the choke rod arm 82 in a direction toward the bimetal strip as engine temperature sensed by the bimetal strip 76 increases after the engine is started. As best shown in FIG. 5, the choke rod arm 82 engages a prong 48 on the choke shaft arm 44 to cause rotational movement of the choke shaft arm 44 causing rotational movement of the choke shaft 42 and positioning the choke plate 40 in the open position. As the engine temperature sensed by the bimetal strip 76 decreases, such as when the engine is shut off, the bimetal strip exerts a force on the choke rod 84 and choke rod arm 82 in a direction away from the bimetal strip. In this state, the choke rod arm 82 is no longer acting to engage the prong 48 to open the choke plate 40. A spring 92 biases the prong 48 of the choke shaft arm 44 against the choke rod arm 82 to rotatably move the choke plate 40 to a more closed position to facilitate restarting of the engine at a later time. The rigid connection between the bimetal strip 76 and the engine 14 is preferably adjustable to permit adjustment of the choke plate positioning for a given temperature.

The automatic choke 10 of the preferred embodiment includes structure for automatically moving the throttle lever 64 and throttle plate 60 during operation of the engine. In the preferred embodiment, an engine speed governing apparatus or governor 86 is provided to move the throttle lever 64 and throttle plate 60 to limit the maximum speed of the engine 14 and output shaft 16. Preferably, the governor 86 is a conventional mechanical governor employing spring loaded flyweights (not shown). As best shown in FIGS. 1–2, the governor 86 includes a governor arm 88 attached to a governor rod 90 which attaches to the throttle lever 64. Typically at start up of the engine 14, the throttle plate 60 is in the open position. After start up of the engine, the engine speed increases until the governor 86 activates. The governor arm 88 and the governor rod 90 then move the throttle plate from the open position toward a more closed position to limit the maximum speed of the engine. As the throttle lever 64 rotatably moves the throttle plate 60, the cam surface 70 slidably engages the second elongate member 52 of the choke shaft arm 44 to rotatably move the choke plate 40. As noted above, this interaction occurs during start up to properly position the choke plate 40 at a time when the temperature responsive device 74 does not position the choke plate in a sufficiently open position. The governor 86 may move the throttle plate 60 back to a more open position at a later time should the engine be placed under an additional load which acts to reduce the speed of the engine requiring an increased flow of fuel and air mixture.

In the preferred embodiment, the choke plate 40 is designed to flutter during and for a short period immediately after start up. The fluttering occurs between the position determined by the temperature responsive device 74 and a more open position. It is believed that fluttering provides the engine 14 with additional air so that the engine output becomes fast enough to require activation of the engine speed governor 86 sooner to rotate the throttle plate 60 toward a more closed position which rotates the choke plate 40 sooner to a more open position. Without fluttering, the engine 14 may be more likely to stall unless the choke plate 40 is moved to a more open position immediately after start up. Fluttering of the choke plate 40 is accomplished by positioning the choke shaft 42 parallel to and offset on a major surface 54 of the choke plate 40 such that the axis of rotation 46 is offset relative to the choke plate 40. When an unequal air pressure exists on the exterior of the carburetor 20 relative to the interior, the choke plate 40 will temporarily move from the closed position toward a more open position to increase the air entering the carburetor 20. The unequal air pressure is created by periodic suction or inhalation from the engine 14 during start up. The spring 92 biases the choke plate back to the position determined by the temperature responsive device 74. Fluttering occurs while the pressure differential is greater than the spring biasing force.

Figure 3:
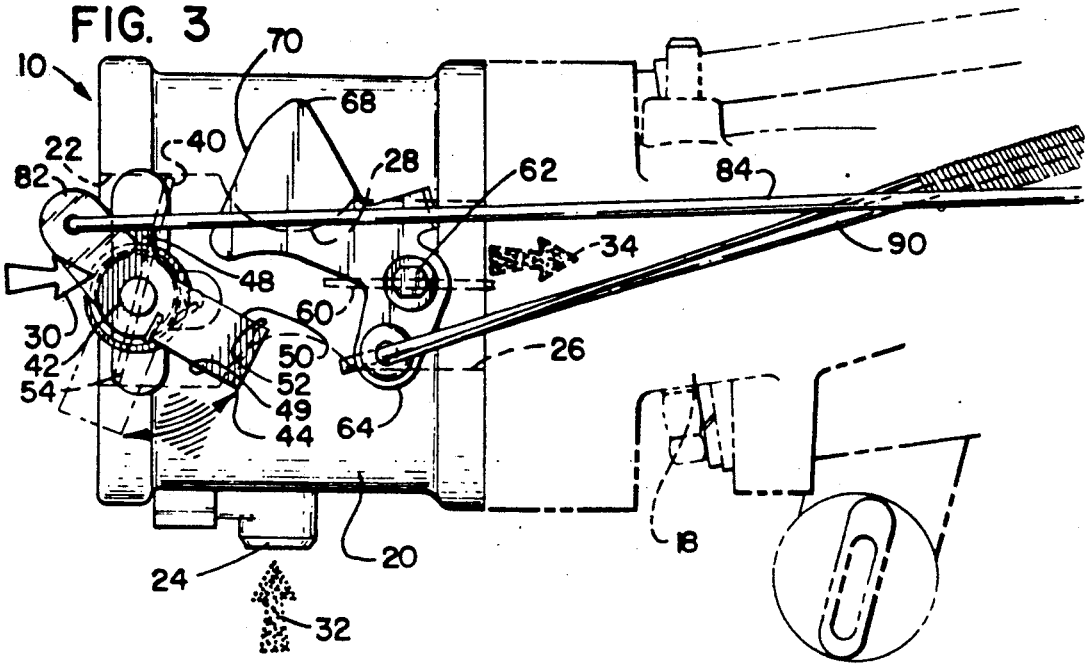
FIG. 3 is a partial enlarged top view of the automatic choke apparatus shown in FIG. 1 showing the positions of several elements of the apparatus when the engine is started.

FIGS. 3–6 illustrate the positions of the choke plate 40 and the throttle plate 60 at various times during operation of the engine 14. FIG. 3 illustrates the automatic choke 10 at start up. During cold ambient starts, the temperature device 74 positions the choke plate 40 in the closed position to facilitate start up. The throttle plate 60 is initially in the open position. It should be noted that the throttle plate 60 may be maintained in the open position before start up or, alternatively, the throttle plate may be placed in that position at start up. As shown in FIG. 3, the throttle lever 64 does not engage the choke shaft arm 44 and the choke rod arm 82 engages the prong 48 of the choke shaft arm 44. During and immediately after start-up, the choke plate 40 begins to flutter as the engine periodically inhales air. The suction of the engine 14 temporarily creates an unbalanced force on the choke plate 40 which overcomes the biasing of the spring force to temporarily rotate the choke plate 40 to a more open position. A result of the fluttering is to more quickly activate the governor 86 to limit the maximum speed of the engine.

Figure 4:
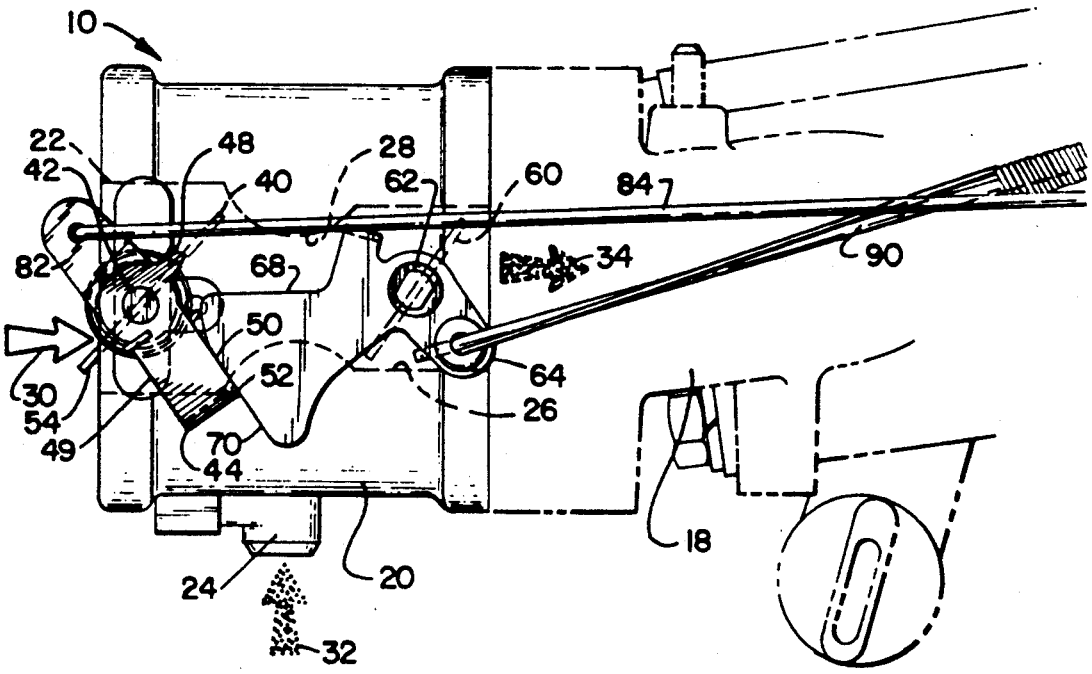
FIG. 4 is a partial enlarged top view of the automatic choke apparatus shown in FIG. 1 showing the positions of several elements shortly after the engine is started.

FIG. 4 illustrates the automatic choke 10 shortly after start up. As noted above, the positions of the elements illustrated in FIG. 4 will occur sooner because of the fluttering feature described above. The governor 86 has moved the throttle plate 60 to a more closed position. Movement of the throttle lever 64 causes the cam surface 70 to slidably engage the choke shaft arm 44 to rotatably move the choke plate 40 to a more open position. As shown in FIG. 4, a space exists between the choke rod arm 82 and the prong 48, illustrating the necessity of the throttle lever 64/choke shaft arm 44 interaction to position the choke plate in a more open position that could not be accomplished with the temperature responsive device 74.

FIG. 5 illustrates the automatic choke 10 once the engine 14 has been running for a period of time and is under a light load. The governor 86 has moved the throttle lever 64 such that the throttle plate 60 is in a more closed position than the position shown in FIG. 4. The temperature responsive device 74 has sensed an increase in engine temperature and has reacted to position the choke plate 40 in the open position. As illustrated in FIG. 5, the prong 48 engages the choke rod arm 82 and the throttle lever 64 is not engaging the choke shaft arm 44.

Figure 6:
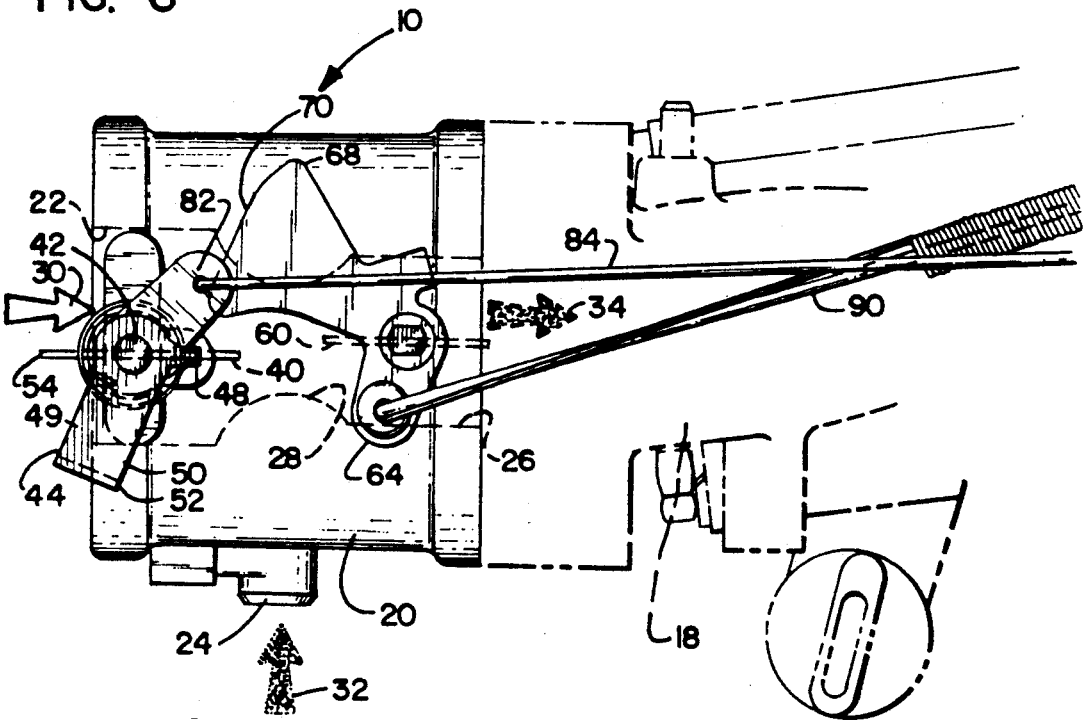
FIG. 6 is a partial enlarged top view of the automatic choke apparatus shown in FIG. 1 showing the positions of several elements of the apparatus when the engine is running at heavy load and warmed.
Figure 7:
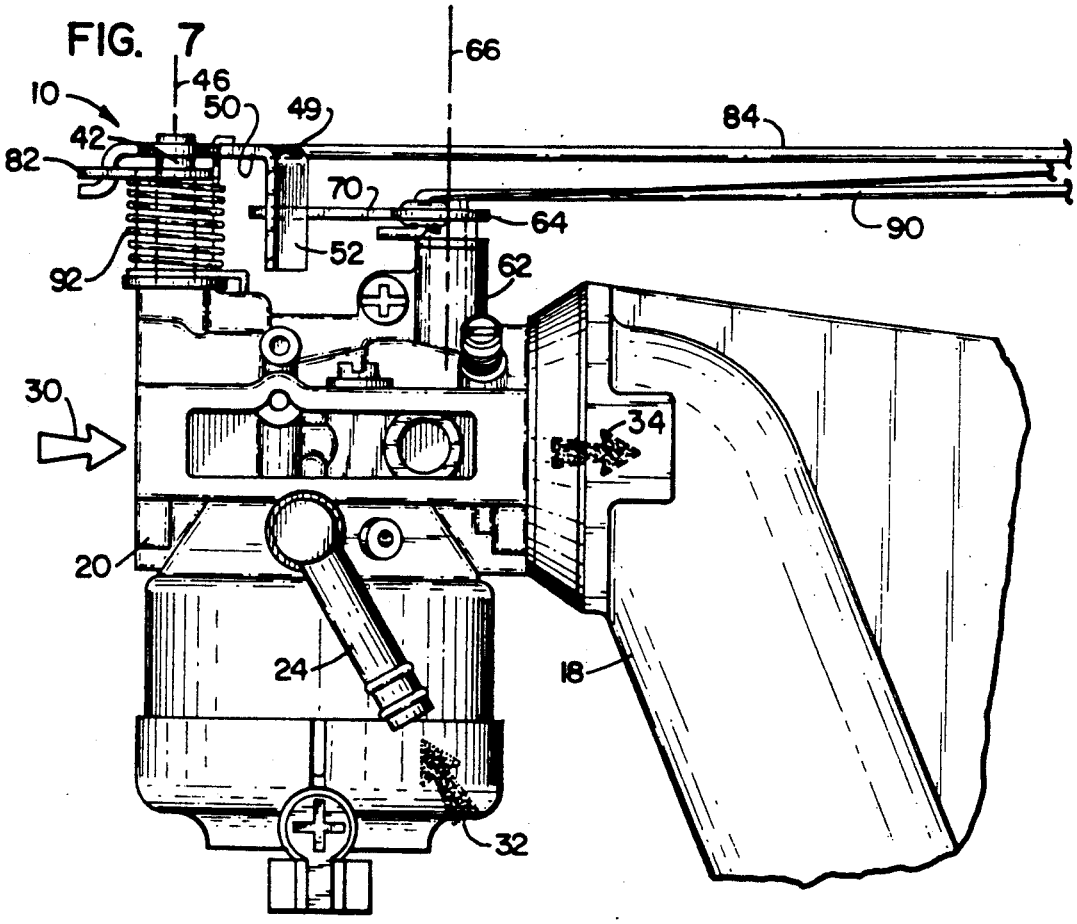
FIG. 7 is a partial enlarged front view of the automatic choke apparatus shown in FIG. 1.

FIG. 6 illustrates the position of the automatic choke 10 when the engine 14 has been running for a period of time and the engine 14 is under a heavy load. As in FIG. 5, the temperature responsive device 74 has sensed an increase in engine temperature and has reacted to position the choke plate 40 in the open position. Since the engine is under a heavier load compared to the load illustrated in FIG. 5, the governor 86 tries to maintain a constant maximum engine speed and has moved the throttle plate 60 to a more open position to increase the flow of air and fuel mixture exiting the carburetor.

The following example illustrates the manner in which the automatic choke 10 of the present invention may be employed in connection with the engine 14 used to power a generator as part of a generator set. One type of generator set that may be used includes a single cylinder, four-stroke, air-cooled engine which drives a generator of the two pole, brush-type which generates 4000 watts of power at 3600 rpm governed engine speed. It has been found that the engine performs well if the temperature responsive device 74 positions the choke plate 40 is in the closed position, shown in FIG. 3, at 32 degrees Fahrenheit sensed by the temperature responsive device and in the open position, shown in FIGS. 5 and 6, at 120 degrees Fahrenheit.

It is to be understood, that even though numerous characteristics and advantages of the invention have been set forth in the foregoing description, together with details of the structure and function of the invention, the disclosure is illustrative only, and changes may be made in detail, especially in matters of shape, size, and arrangement of the parts within the principles of the invention to the full extent indicated by the broad general meaning of the terms in which the appended claims are expressed.

We claim:

1. A method of preventing stalling during starting of an internal combustion engine in cold ambients comprising the steps of:

providing a carburetor mountable to the engine having an air inlet, a fuel inlet, and an air and fuel mixture outlet, the carburetor further having a choke plate rotatably mounted in an interior of the carburetor and a choke shaft arm connected to the choke plate, the choke shaft arm rotatably moving the choke plate, the carburetor further having a throttle plate rotatably mounted in the interior of the carburetor downstream of the choke plate and a throttle lever connected to the throttle plate, the throttle lever rotatably moving the throttle plate, the throttle lever mechanically linked with the choke shaft arm during rotational movement of the throttle plate to cause rotational movement of the choke plate;

positioning the choke plate in a closed position wherein a flow of fuel entering the engine is greater than when in an open position;

positioning the throttle plate in an open position wherein a flow of air and fuel mixture exiting the carburetor at the air and fuel mixture outlet is greater than when in a closed position;

starting the engine; and rotating the throttle plate toward the closed position after the engine is started wherein the flow of air and fuel mixture exiting the carburetor is decreased, the rotation of the throttle plate causing the throttle lever to slideably engage the choke shaft arm, rotation of the choke shaft arm causing rotation of the choke plate toward the open position wherein the flow of fuel entering the engine is decreased.

2. A choke pull off device for use on a carburetor of an engine having an engine speed governor, the carburetor having a choke plate rotatably mounted to the carburetor about a choke shaft defining an axis of rotation for the choke plate, the carburetor further having a throttle shaft defining an axis of rotation of the throttle plate, the choke pull off device comprising:

a choke shaft arm mountable to the choke shaft, the choke shaft arm rotatably moving the choke plate about the axis of rotation of the choke plate; and a throttle lever mountable to the throttle shaft, the throttle lever rotatably moving the throttle plate about the axis of rotation of the throttle plate, the throttle lever including mechanical linkage means for engaging the choke shaft arm during rotational movement of the throttle plate by the engine speed governor to rotatably move the choke plate from a closed position to an open position, wherein the mechanical linkage means includes the throttle lever slideably engaging the choke shaft arm during rotational movement of the throttle plate to rotatably move the choke plate.

3. The choke pull off device of claim 2, wherein the throttle lever includes a cam surface engagable with the choke shaft arm.

4. The choke pull off device of claim 3, wherein the throttle lever includes a cam plate portion generally perpendicular to the axis of rotation of the throttle plate, the cam surface forming an edge of the cam plate portion, and the choke shaft arm including a first elongate member extending generally perpendicular to the axis of rotation of the choke plate and a second elongate member extending from the first elongate member generally parallel to the axis of rotation of the choke plate, the second elongate member engaging the cam surface during rotational movement of the throttle plate to rotatably move the choke plate.

5. The choke pull off device of claim 2, wherein the choke shaft arm and the throttle lever are located on an exterior of the carburetor.

6. An automatic choke apparatus for use in starting an internal combustion engine comprising:

a carburetor having an air inlet, a fuel inlet, and an air and fuel mixture outlet;

a choke plate mounted for variable rotation in an interior of the carburetor adjacent the air inlet between a closed position wherein a flow of air entering the carburetor through the inlet is substantially obstructed and an open position wherein the flow of air entering the carburetor is substantially unobstructed, the choke plate being rotatable toward the open position after starting, the choke plate having a choke shaft arm rotatably moving the choke plate; and a throttle plate downstream from the choke plate and the fuel inlet mounted for variable rotation in the interior of the carburetor between an open position wherein a flow of mixed air and fuel exiting the carburetor through the outlet is at a maximum and a closed position wherein the flow of mixed air and fuel exiting the carburetor is at a minimum, the throttle plate being rotatable toward the closed position after starting, the throttle plate having a throttle lever rotatably moving the throttle plate, the throttle lever being engageable with the choke shaft arm during rotational movement of the throttle plate to rotatably move the choke plate.

7. The automatic choke apparatus of claim 6, further comprising temperature responsive means for positioning the choke plate based on engine temperature sensed by the temperature responsive means, the temperature responsive means positioning the choke plate toward the closed position as the engine temperature sensed decreases, the temperature responsive means positioning the choke plate toward the open position as the engine temperature sensed increases, the throttle lever and choke shaft arm engagement moving the choke plate toward the open position before the temperature responsive means activates to sufficiently open the choke plate.

8. The automatic choke apparatus of claim 7, wherein the temperature responsive means includes a bimetal strip having one end mounted to the engine and a second end mounted to the choke plate.

9. The automatic choke apparatus of claim 8, further comprising biasing means for urging the choke plate toward the closed position, the biasing means cooperating with the temperature responsive means to move the choke plate toward the closed position as the engine temperature sensed decreases, the biasing means permitting the choke plate to flutter between the position determined by the temperature responsive means and a more open position during starting, the biasing means permitting the choke plate to be moved to a more open position by the throttle lever and choke shaft arm engagement.

10. The automatic choke apparatus of claim 9, wherein the choke plate has a choke shaft pivotally mounting the choke plate to the carburetor, the choke shaft defining an axis of rotation parallel to and offset on a major surface of the choke plate wherein a greater air pressure on an exterior of the carburetor than on the interior of the carburetor creates an unbalanced force on the choke plate and rotatably moves the choke plate to a more open position when the force created by the air pressure differential is greater than the biasing force exerted by the biasing means.

11. The automatic choke apparatus of claim 10, wherein the biasing means includes a spring.

12. The automatic choke apparatus of claim 6, further comprising governor means for moving the throttle late to limit the maximum speed of the engine, the governor means urging the throttle plate toward the closed position after the engine is started such that the throttle lever engages the choke shaft arm and rotatably moves the choke plate toward the open position.

13. The automatic choke apparatus of claim 12, wherein the governor means is a mechanical governor.

14. The automatic choke apparatus of claim 6, wherein the throttle lever includes a cam surface engagable with the choke shaft arm.

15. The automatic choke apparatus of claim 14, wherein the throttle lever includes a cam plate portion generally perpendicular to an axis of rotation of the throttle plate, the cam surface forming an edge of the cam plate portion, and the choke shaft arm including a first elongate member extending generally perpendicular to an axis of rotation of the choke plate and a second elongate member extending from the first elongate member generally parallel to the axis of rotation of the choke plate, the cam surface engagable with the second elongate member.

16. The choke pull off device of claim 6, wherein the choke shaft arm and the throttle lever are located on an exterior of the carburetor.

17. An internal combustion engine having an automatic choke comprising:

a carburetor including:

a choke plate having a choke shaft, the choke plate mounted in an interior of the carburetor for variable rotation about an axis defined by the choke shaft, and a choke shaft arm connected to the choke shaft and rotatably moving the choke shaft and choke plate;

means for supplying air to the carburetor;

means for supplying fuel to the carburetor to be mixed with the air in the carburetor;

a throttle plate having a throttle shaft, the throttle plate positioned in the interior of the carburetor downstream of the choke plate and the means for supplying fuel and mounted for variable rotation about an axis defined by the throttle shaft, and a throttle lever connected to the throttle shaft and rotatably moving the throttle shaft and throttle plate, the throttle lever being engageable with the choke shaft arm as the throttle lever rotatably moves the throttle plate; and means for supplying a mixture of fuel and air from the carburetor to a combustion means;

temperature responsive means for positioning the choke plate in an open position as the engine temperature sensed increases; the temperature responsive means positioning the choke plate in a closed position as engine temperature sensed decreases;

combustion means for converting the air and fuel mixture to rotational movement of an engine output shaft;

an engine output shaft; and governor means for moving the throttle lever for positioning the throttle plate to limit the maximum rotational speed of the engine output shaft, the governor means urging the throttle plate from an open position toward a closed position after the engine is started such that the throttle lever rotatably moves the choke shaft arm which rotatably moves choke plate toward the open position before the temperature responsive means activates to sufficiently open the choke plate.

18. The internal combustion engine of claim 17, wherein the temperature responsive means includes a bimetal strip having one end connected to the engine, and a second end connected to the choke shaft.

19. The internal combustion engine of claim 17, wherein the governor means is a mechanical governor.

20. The internal combustion engine of claim 17, wherein the throttle lever includes a cam plate portion extending from the throttle shaft and having a cam surface, the cam surface forming an edge of the cam plate portion, the choke shaft arm including an elongate member extending from the choke shaft, the elongate member slideably engaging the cam surface during rotational movement of the throttle plate to rotatably move the choke plate.

21. The internal combustion engine of claim 17, wherein the carburetor further includes flutter means for permitting the choke plate to temporarily move to a more open position during starting before returning to a less open position determined by the temperature responsive means.

* * * * *

UNITED STATES PATENT AND TRADEMARK OFFICE

CERTIFICATE OF CORRECTION

PATENT NO. : 5,069,180

DATED : December 3, 1991

INVENTOR(S) : Schmidt et al.

It is certified that error appears in the above-identified patent and that said Letters Patent is hereby corrected as shown below:

Abstract, item [57], line 17,
DELETE "miving" and INSERT therefor --moving--.

Column 3, line 29
INSERT "the" after the word "moves".

Column 8, line 67
DELETE "is" after the numeral "40".

Column 11, line 23
DELETE "late" and INSERT therefor --plate--.

Column 12, line 32
INSERT --the-- after the word "moves".

Signed and Sealed this

Third Day of August, 1993

*Attest:*

Michael K. Kirk

MICHAEL K. KIRK

*Attesting Officer*

*Acting Commissioner of Patents and Trademarks*